United States Patent [19]

Farkas

[11] 4,287,831

[45] * Sep. 8, 1981

[54] FRICTION AND RACK AND PINION LOCOMOTIVE

[76] Inventor: Laszlo Farkas, Am Hang 31, 4713 Bockum-Hövel, Fed. Rep. of Germany

[ * ] Notice: The portion of the term of this patent subsequent to Jan. 9, 1996, has been disclaimed.

[21] Appl. No.: 941,454

[22] Filed: Sep. 12, 1978

Related U.S. Application Data

[63] Continuation of Ser. No. 817,105, Jul. 29, 1979, Pat. No. 4,133,267.

[30] Foreign Application Priority Data

Jul. 20, 1976 [DE] Fed. Rep. of Germany ..... 2632506

[51] Int. Cl.[3] ..... B61B 3/00; B61B 13/02; B61C 11/04; B61C 13/04

[52] U.S. Cl. ..... 105/29 R; 74/325; 104/99; 105/30; 105/150; 299/42

[58] Field of Search ..... 105/148, 150, 29 R, 105/30, 71, 75; 299/42, 43; 74/325, 346, 364, 405; 104/99

[56] References Cited

U.S. PATENT DOCUMENTS

| | | | |
|---|---|---|---|
| 233,349 | 10/1880 | Howe, Jr. | 105/29 R |
| 569,097 | 10/1896 | Fryer | 105/29 R X |
| 572,111 | 12/1896 | Griffiths | 105/29 R X |
| 909,430 | 1/1909 | Levin | 105/29 R |
| 928,435 | 7/1909 | Felts | 104/99 |
| 1,124,990 | 1/1915 | Austin | 105/29 R |
| 1,709,079 | 4/1929 | Kindl | 74/346 X |
| 3,262,593 | 7/1966 | Hainer | 105/29 R |
| 3,456,597 | 7/1969 | Jackson | 105/150 X |
| 3,673,966 | 7/1972 | Wilson | 105/29 R X |
| 3,830,338 | 8/1974 | Svensson | 105/30 X |
| 4,133,267 | 1/1979 | Farkas | 105/29 R |

FOREIGN PATENT DOCUMENTS

| | | | |
|---|---|---|---|
| 313784 | 7/1919 | Fed. Rep. of Germany | 105/29 R |
| 451741 | 11/1927 | Fed. Rep. of Germany | 105/29 R |
| 1430992 | 3/1969 | Fed. Rep. of Germany | 105/30 |
| 2453751 | 5/1976 | Fed. Rep. of Germany | 105/30 |
| 146289 | 12/1881 | France | 105/29 R |

*Primary Examiner*—Joseph F. Peters, Jr.
*Assistant Examiner*—Howard Beltran
*Attorney, Agent, or Firm*—Michael J. Striker

[57] ABSTRACT

This invention relates to a suspension railroad in mines, including a monorail having an elongated friction section and an elongated rack section located above the friction section, a car suspended on the monorail and driven for moving the car along the rail including a friction wheel in frictional engagement with the friction section, a gear wheel coaxial with the friction wheel, and a shiftable device for moving the gear wheel into and out of engagement with the rack section.

10 Claims, 6 Drawing Figures

FRICTION AND RACK AND PINION LOCOMOTIVE

This application is a continuation of the application Ser. No. 817,105 filed July 29, 1979, now U.S. Pat. No. 4,133,267, issued Jan. 9, 1979.

A monorail drive is disclosed in the prior art, the locomotive is provided with double drivers with such axially arranged driving friction wheels and driving gear wheels which permit the lowest possible structure of the double drive. For achieving this, the double driver must have the driving gear wheel movable into and out of engagement with the rack section to make it possible that the driving engine (such as for instance a Diesel locomotive or a local shuttling engine) together with a small number of cars or with unloaded cars will be enabled to be run exclusively by driven friction wheels also along the lengths of the rack section.

Now, this invention has the object of improving this older drive for a drawing engine (e.g. a suspended track locomotive or a shuttling local engine) in regard to applied stresses and stability, as well as of achieving a functionally reliable mode of operation thereof. Thereby, the lowest possible height of the gearing arrangement is maintained and the driving toothed wheels is particularly well and operatively reliably supported by their respective hollow axles carrying these toothed wheels by means of a lifting arrangement contiguous with an elongated hollow shaft, the driving toothed wheels with their indented rims also having to be retractable into protecting chambers installed in the driving wheels.

The improved travel drive according to the invention is characterized in that each toothed wheel or gear wheel includes a downwards extending long hollow axle forming a double-action lifting cylinder whereinto there is introduced a fixed piston rod coupled at its bottom end to the gearing unit and having in its lower region control ducts and in its upper region a disc piston. The piston rod itself is axially shiftably guided in a torque transmitting manner in an also elongated downwards extending rotarily drivable hollow shaft that forms at its lower terminal a carrier for a driving gear and at its top terminal the bearing for the driving friction wheel which latter is provided at its upper side with a circular and peripherally embracing protecting chamber shaped to receive the driving toothed wheel together with its indented rim in its retracted position.

The gear wheel is thus turnably mounted with its long hollow axle in a considerably stable and secure mode and is axially shiftable in a motorically drivable hollow shaft upon which there are provided in mutual axial spacing a driving gear and the gear wheel. This kind of construction enables the long hollow axle of the travel driving toothed wheel to be employed as a double-action lifting cylinder. The piston rod of the lifting cylinder lies fixedly and stably supported in the gearing unit and thanks thereto is enables an advantageous positioning of the control ducts for supply and release of the pressurized fluid or of some appropriate medium operatively loading the lifting cylinder.

Such a good central carrying location of the gear on the hollow shaft bearing the friction wheel makes possible to use the top side of this friction wheel for forming therein a circular protecting chamber sized to receive in its full height the gear wheel with its indented rim.

The gear wheels are thus, for the entire duration of the exclusive propulsion by action of the driving friction wheels, so deeply retracted in said protecting chambers that no one of these rotary toothed wheels tends to obstruct the due function. This retraction of the wheel toothed rim into the deeply sunk protecting chamber, namely a chamber having its bottom positioned deep in the interior of the body of the friction wheel makes besides possible to establish the rack section on the monorail adjacent, the upper flange plane of the rail in form of an I-beam. Consequently, the rack section of the rail may be simply and stably affixed to the flange of the track rail, the result whereof is the preservation of the intended low constructional height. Also the distance of the surge of the gear wheel is correspondingly small. For forming the indented rail segments rack sections on the head side of the track rail, use will be made of such indented rail segments that possess on either longitudinal side laterally projecting driving indentations, the surge of the gear wheel occurs at each occasion before reaching in the travel the indented track. The retraction of the wheel correspondingly follows the running out of each indented track.

A well designed embodiment of the travel drive resides according to the invention in a construction where the gear wheel is integral with said hollow axle devised as a lifting cylinder and where an annular piston operating as a resilient closure (lid) of the upper pressure chamber of the lifting cylinder is located upon a piston rod extension arranged over the disc piston on a fixed piston rod and support is provided for said annular piston from above and below by coil springs abutting arresters located in the hollow axle.

This annular piston positioned in this way between such springs ensures that the surge of the gear wheel occurs in an elastic way, so that there is avoided any blocking. Also the upper pressure chamber in the lifting cylinder that is to be loaded with a driving medium may be reduced to the necessary small extent and the volume of the control fluid may be maintained very low.

Another important improvement in the travel drive brought in by the invention is characterized by the fact that there are suspended at the bottom side of the driving toothed wheel at least two interconnected shielding annular bodies telescopically shiftable into one another, which bodies together with the indented rim are retracted into the circular protecting chamber provided in the driving friction wheel and may be elevated to have a horizontal bottom flange provided on the lower annular body up to the border of the circular protecting chamber in the upwards projecting position of the gear wheel.

These shielding annular bodies suspended on the driving gear wheel cover the protecting chamber from above to such a degree that, when the driving toothed wheel is in its fully raised position, no dirt can deposit in the protecting chamber. These bodies however do not obstruct in any manner whatsoever the needed deep retraction of the gear wheel with its indented rim into said protecting chamber.

A well devised embodiment of the protecting space is advantageously built-up in a manner such that the circular protecting chamber having to receive the driving gear wheel with its indented rim and its shielding annular bodies is formed from an insertable cylinder located in a correspondingly large circular space formed in the wheel body of the gear wheel, which cylinder however is in axial length larger than the depth of the circular space in said wheel body. The axially measured width of this body of the driving friction wheel can be thus limited to the smallest possible dimension dependent on the running surface of the friction wheel.

The accompanying drawings illustrate the travel drive according to this invention in two embodiments.

Figure 3:
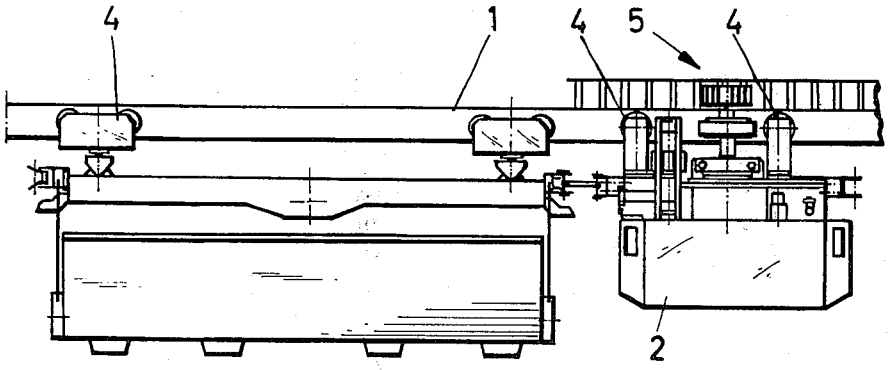
Figure 4:
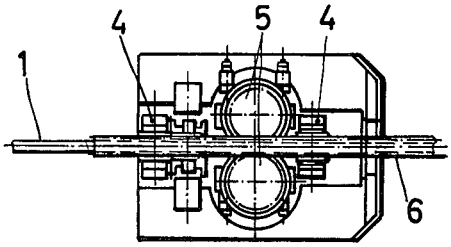
Figure 5:
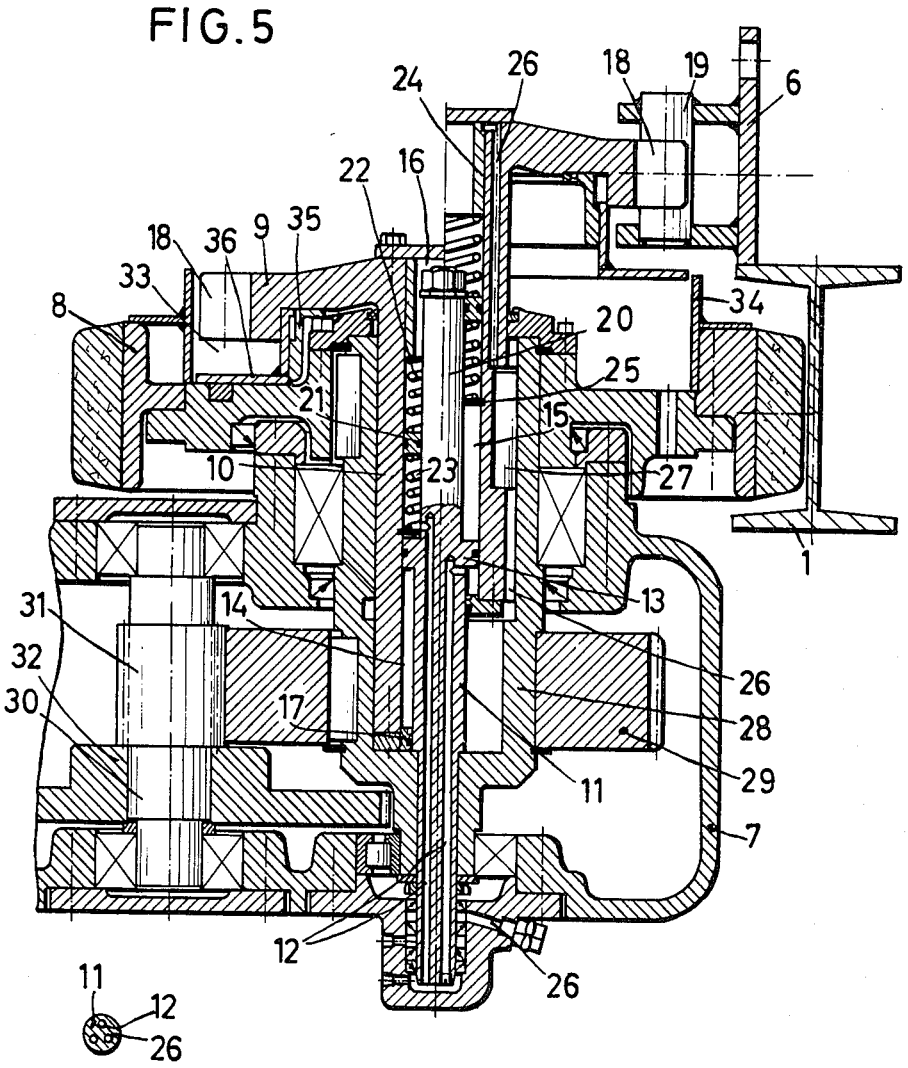
Figure 6:
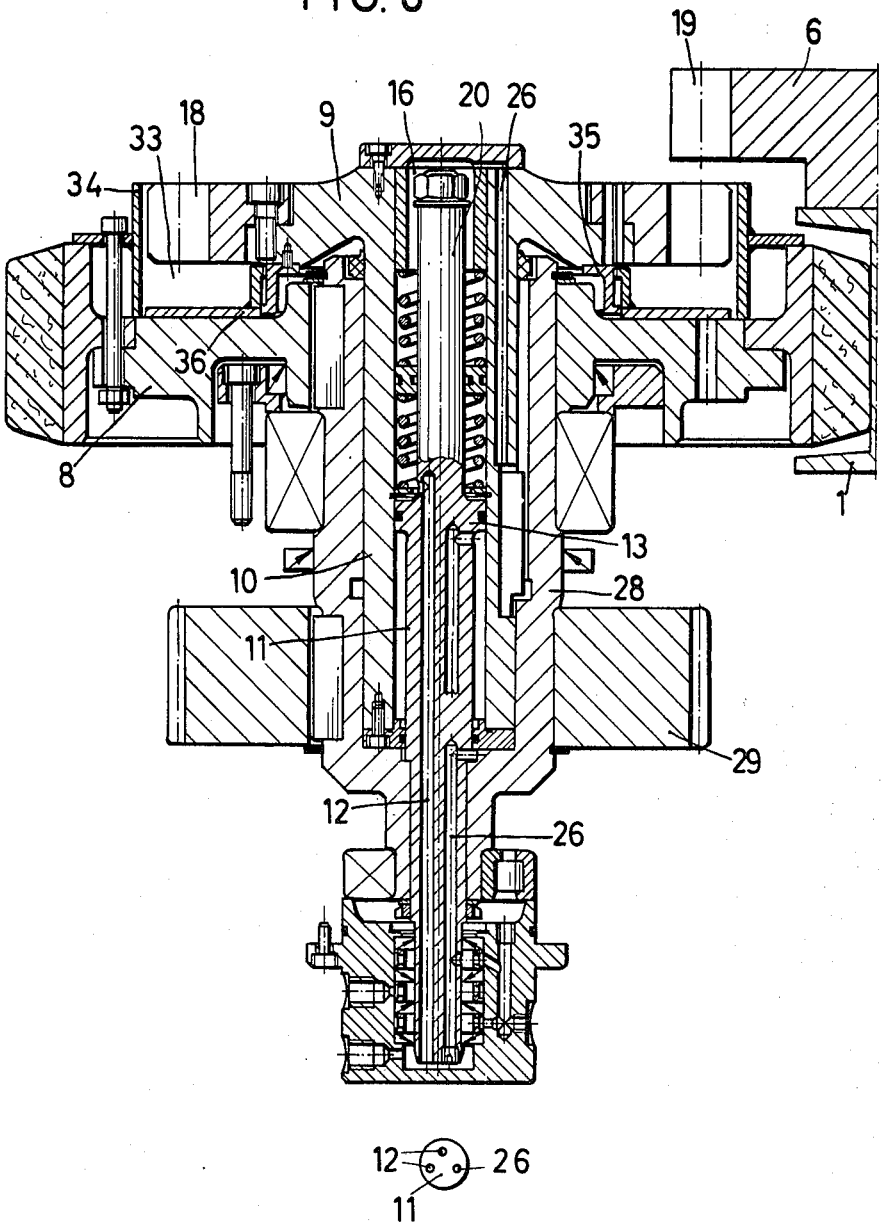

FIG. 3 displays the employment of the travel drivers in connection with a local shuttling engine being the driving engine there utilized;

FIG. 4 is a plan view of the arrangement of the drivers on either side of the riding rail;

FIG. 5 illustrates in a vertical cross-sectional view the structure of a double drive in an arrangement lateral to the one rail;

FIG. 6 shows a further exemplary embodiment of the doubled drive in a vertical cross-section.

Figure 1:
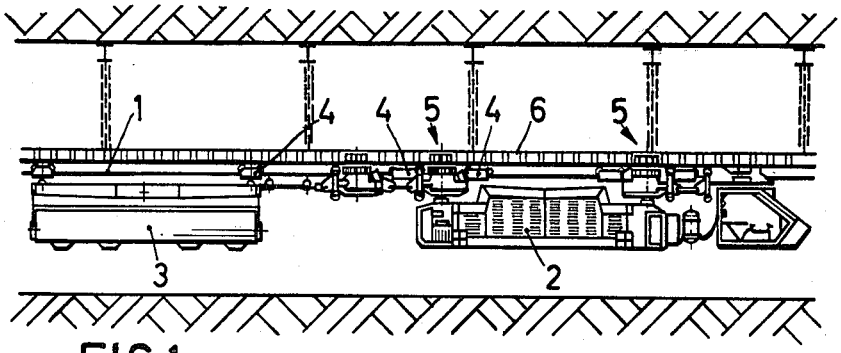
FIG. 1 shows a section of a mine track with a there established one rail suspended rail road.
Figure 2:
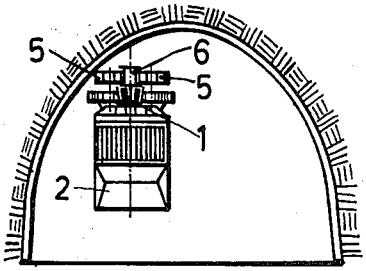
FIG. 2 is a cross-section referred to FIG. 1.

FIGS. 1 and 2 demonstrate a one-rail suspended railroad track in a mine with the rail suspended on the track construction. The drawing engine 2 and the transport cars 3 pulled by the same are suspended by means of per-se known members 4 upon the rail. FIG. 1 shows a Diesel locomotive being here the utilized drawing engine 2 that has, in addition to the members 4, drive means 5 executed as doubled driving means and consisting in each individual case of a friction driver and a gear driver. The structure of these drivers is described herein after in connection with FIGS. 5 and 6.

The top side of the profile of the I-beam shaped rail 1 is equipped adjacent the top flange in sequential sections with rack sections 6. Such rack sections are provided whereever there are climbing or slanting sections engendering difficulties in the travel of such a train along the rail and where the friction wheel drivers are of a little efficiency. There also may be the question of rack sections where the effectiveness of the drive by means of the friction drivers becomes questionable in view of the there deposited grease and dirt sediments. In particular, regarding long trains and heavily loaded transport vehicles, the friction drive in such a mentioned section is insufficient. Contrary thereto, it has appeared that alone riding drawing engines and drawing engines with few unloaded cars may be propelled at a higher speed when driven by the friction drive only. The here provided drives are therefore constructed so that the gear wheels of the travel drive arrangement are retractable to such a degree that they can pass underneath the rack section and, being so adjusted, may be caused to engage and catch the lateral indentations on the rack section in upwardly expelled position in case only of arisen need.

FIG. 3 displays the drawing engine 2 in the form of a local shuttling engine. Here, on either side of the rail 1, a double driving means is provided as the drive means 5.

FIG. 4 makes apparent that also in this case the double driving means are located in a symmetrical disposition on either side of the rail 1. The drawing engine 2 has located ahead of, and beyond, the driving means 5 members 4 by means of which the drawing engine is suspended on the rail.

A specific constructional configuration of the driving means is shown in by FIG. 5. The there illustrated double drive is located adjacent the rail 1. There are provided, as is per-se known, in a symmetrical arrangement on either side of the rail identical double driving means, the gearing casings whereof my be mutually connected.

Inside the gearing casing 7, or on an engine frame replacing such a gearing casing, there are provided a driving friction wheel 8 and a driving gear wheel 9. The driving friction wheel 8 lies in a horizontal position at the level of the rail and may be pressed against the stem of the rail. The driving gear wheel 9 is contiguous with a downwardly extending long hollow shaft 10 forming a double-action lifting cylinder. Into this hollow shaft, a piston rod 11 is inserted affixed at its lower terminal to the gearing casing 12 and carrying at its upper terminal a disc piston 13. This disc piston divides the inner space of the hollow shaft 10 serving as a lifting cylinder into a lower pressure chamber 14 and an upper pressure chamber 15. Either of these pressure chambers comprises a port from a control duct 12 that alternatingly supplies and drafts off the control fluid. There is a third control duct in the piston rod whose exclusive role it is to vent a further chamber 16 located above the upper chamber 15, being closed frontally of the driving gear wheel and serving for location of a springing element in the herein after described manner. The lower pressure chamber is closed at its bottom side by an annular lid 17 bound to the lower frontal side of the hollow shaft 10.

The pressure charging of the upper chamber 15 of the lifting cylinder propels upwards the hollow shaft 10 and the driving gear wheel 9 fixed at its headside. The stroke is envisaged to be so great that the indented rim 18 be pushed onto the high level of the lateral indentation 19 of the rack section 6. At this instant, the drawing engine moves in the travel direction, so that the driving gear wheel engagingly runs into the lateral indentation of the rack section 6. After the rack section has been passed, an appropriate coupling causes pressure loading of the lower pressure chamber 14 in the lifting cylinder. Now, the driving gear wheel 9 is lowered in effect of a downward movement of its hollow shaft 10, so that the gear wheel is moved underneath, the rail rack section 6. In this condition, the driving gear wheels are run below the next rack sections.

In the hollow shaft 10 of the gear wheel 9 is a cylindrical piston rod extension 20 arranged over the disc piston 13 on the fixed piston rod 11 and upon this disc piston, an annular piston 21 is positioned being axially movable as a resilient closure (lid) of the upper pressure chamber 15 in the lifting cylinder. This annular piston 21 is supported from above and below by coil springs 22,23. These coil springs abut at their outer ends arresters 24 and 25 arranged inside the hollow shaft 10. When the upper pressure chamber 15 is pressure loaded, this annular piston 21 may be shifted against the biasing force of the respective spring when for whatever reason the raising of the driving gear wheel is aggravated or even blocked. Thus, the surge of the driving gear wheel occurs elastically. As soon as the driving gear wheel regains a free movability, it progresses to its high position, while the annular piston returns to its normal middle position between the pair of coil springs. Venting of the chamber 16 at the head end of the hollow axle is ensured through the channels 26. Through the same channels, the chamber 16 is vented when the driving gear wheel 9 is retracted into its low position.

The hollow shaft 10 is guided axially shiftably by per se known means 27 (a spring, a nut) with a torque moment transmission in an elongated hollow shaft 28 extending in upward direction. The length of this hollow shaft 28 corresponds mostly to the length of the hollow shaft 10 of the driving gear wheel 9. This hollow shaft 28 forms in its lower section carrier for a gear 29. At the upper end of the hollow shaft 28 is located the driving friction wheel 8 with its wheel body. The driving friction wheel 8 is connected with the hollow shaft 28 in a torque transmitting coupling. In the gearing casing 7, there are affixed to an adjacent shaft 30 the driving gears 31 and 32, which are driven by a not represented driving motor. This gearing transfers the torque moment simultaneously onto the driving friction wheel 8 and the driving gear wheel 9.

The driving friction wheel 9 is provided with a circular protecting chamber 33 shaped to receive in the retracted position the driving gear wheel 9 with its indented rim 18. This protecting chamber circumscribes the indented rim of the gear wheel 9 and has a depth corresponding at least to the thickness of this gear wheel. Preferably however the depth of this protecting chamber is greater for being capable of housing also the herein after described elements. Thereby at least a portion of this depth of the protecting chamber is formed by a deep cavitation in the top region of the body of the friction wheel. Into the thus formed cavity, an insertable cylinder 34 is introduced which defines the maximum height of the protecting chamber but whose top side does not surpass the flange upper side of the riding rail 1. This insertable cylinder has a T-configured cross-section and includes a horizontally extending shank directed outwardly that serves for fixation of this cylinder to the upper frontal side of the friction wheel.

The bottom side of the driving gear wheel 9 carries suspended thereupon two shielding annular bodies 35,36 that are telescopically shiftable into one another. These annular bodies 35,36 are immersible together with the indented rim 18 into the circular protecting chamber 33. The inner smaller annular body 35 is affixed at its inwardly extending short horizontal flange to the body of the driving gear wheel 9. The downwardly directed flange includes an outwardly directed bulge, or a collar upon which it is suspended the outer annular body 36 having an internally extending collar on its inner vertical annulus. This outer annular body 36 comprises a downwards arranged broad horizontal flange reaching to the cylindrical periphery of the insertable cylinder 34. When the gear wheel 9 is raised and/or pushed upwards, the annular body 35 heightens the outer annular body 36 up to the upper border of the insertable cylinder 34. In effect thereof, the protecting chamber 35 is closed on the surge of the gear wheel 9 such that there can not deposit any dirt sediments. This secures that the driving gear wheel can always be lowered below the lateral indentations of the rack section 6, in which position it is duly protected and avoids any danger of accidents.

The portion of the travel drive reversed from the rail may be additionally provided with protective shieldings that are not shown in the drawing since the above described arrangement of the gear wheel with the shielding annular bodies 35,36 is primarily directed to the prevention of dirt deposits in the protecting chamber. FIG. 5 shows that it could be purposeful to form the indented rim in the form of a collar enlarging in downward direction. This indented rim also can be affixed as a separate annular body to a disc-like wheel body.

The embodiment of the double drive displayed in FIG. 6 has a structure importantly corresponding to that shown in FIG. 5. The description given in regard to FIG. 5 is also adaquate in respect to the structure of FIG. 6. In this FIG. 6, the driving gear wheel comprises a toothed rim formed as a ring having no downwardly enlarging collar. The representation of the piston rod depicts in this case only the control duct 12 leading to the upper pressure chamber 15 in the lifting cylinder and a portion of the air venting and inspiring channel 26 being in constant communication with the venting chamber 16.

I claim:

1. In a suspended railroad, a combination comprising a monorail having an elongated friction section and an elongated rack section, one of said sections being superimposed upon the other section; at least one car suspended on said monorail; and drive means for moving said car along said rail, said drive means comprising a friction wheel in frictional engagement with said friction section, a gear wheel coaxial with said friction wheel and movable in axial direction relative to the latter between an active position engaged with said rack section and an inactive position disengaged therefrom, means for moving said gear wheel between said positions thereof and comprising an elongated hollow shaft coaxially projecting from said gear wheel and forming a double-acting cylinder, stationary piston means in said cylinder and dividing the interior thereof in an upper and lower pressure chamber, means for switching fluid under pressure between said chambers to thereby move said gear wheel between said positions thereof, support means supporting said friction wheel and said gear wheel with said hollow shaft for rotation about a common axis, and means operatively connected to said friction wheel and said gear wheel for simultaneous rotating the same about said common axis.

2. A combination as defined in claim 1, wherein said rack section is arranged above said friction section and wherein said gear wheel is arranged above said friction wheel with said elongated hollow shaft projecting downwardly from said gear wheel.

3. A combination as defined in claim 2, wherein said means for rotating said wheels about said common axis comprise a hollow drive shaft in which said hollow shaft is mounted for reciprocation in axial direction, key means connecting said hollow drive shaft to said hollow shaft and said friction wheel for simultaneous rotation, a gear fixed to a lower portion of said drive shaft, and gear means meshing with said gear for driving said hollow drive shaft.

4. A combination as defined in claim 2, wherein said elongated friction section of said rail is constituted by an I-beam, and wherein said car includes supporting rollers supported on the lower flange of said I-beam.

5. A combination as defined in claim 2, wherein said stationary piston means comprises a disc piston and a piston rod projecting downwardly therefrom and connected at its lower end to said support means for holding said piston stationarily during axial shifting of said hollow shaft.

6. A combination as defined in claim 5, wherein said means for switching fluid under pressure between said chambers, further comprising fluid passage means extending through said piston rod.

7. A combination as defined in claim 5, and including a coaxial extension of said piston rod projecting through said upper pressure chamber, and annular piston about said piston rod extension shiftable along the same and spring means in said upper pressure chamber to opposite sides of said annular piston each abutting with one end thereof against the latter and with the other end respectively against axially displaced abutments fixed to said hollow shaft above said stationary piston.

8. A combination as defined in claim 2, wherein said friction wheel is formed in an upper portion thereof with a circular protection chamber in which said gear wheel is at least partly located in said inactive position.

9. A combination as defined in claim 8, and including an annular wall in said protecting chamber projecting beyond the upper face of said friction wheel, said gear wheel being located in its inactive position substantially within the confines of said annular wall.

10. A combination as defined in claim 9, and including a pair of telescoping shielding members, one fixed to a bottom face of said gear wheel and the other having a radially extending flange having an outer periphery closely adjacent to said annular wall so as to close the space within said annular wall at the upper end during shifting of said gear wheel to said active position.

* * * * *